US009334097B2

(12) United States Patent
Skillin et al.

(10) Patent No.: US 9,334,097 B2
(45) Date of Patent: May 10, 2016

(54) DISPENSING CLOSURE

(71) Applicant: WestRock Slatersville, LLC, Norcross, GA (US)

(72) Inventors: Clifford W. Skillin, Blackstone, MA (US); Patrick J. Brannon, Warwick, RI (US)

(73) Assignee: WestRock Slatersville, LLC, Norcross, GA (US)

( * ) Notice: Subject to any disclaimer, the term of this patent is extended or adjusted under 35 U.S.C. 154(b) by 0 days.

(21) Appl. No.: 14/210,691

(22) Filed: Mar. 14, 2014

(65) Prior Publication Data

US 2014/0263474 A1 Sep. 18, 2014

Related U.S. Application Data

(60) Provisional application No. 61/791,058, filed on Mar. 15, 2013.

(51) Int. Cl.
*B65D 41/32* (2006.01)
*B65D 75/58* (2006.01)

(52) U.S. Cl.
CPC .... *B65D 75/5883* (2013.01); *B65D 2101/0023* (2013.01)

(58) Field of Classification Search
CPC ..... B65D 41/34; B65D 75/5883; B65D 2101/0023; B65D 51/18
USPC ..... 222/541.9, 153.01, 153.07, 92, 107; 215/235
See application file for complete search history.

(56) References Cited

U.S. PATENT DOCUMENTS

| | | | | |
|---|---|---|---|---|
| 5,141,138 | A | 8/1992 | Odet et al. | |
| 5,249,695 | A | 10/1993 | Luch et al. | |
| 5,303,837 | A | 4/1994 | Adams et al. | |
| 5,348,183 | A | 9/1994 | Luch et al. | |
| 5,392,938 | A | 2/1995 | Dubach | |
| 5,911,340 | A | 6/1999 | Uematsu | |
| 6,000,848 | A | 12/1999 | Massioui | |
| 6,003,712 | A | 12/1999 | Mogard et al. | |
| 6,050,451 | A * | 4/2000 | Hess et al. | 222/92 |
| 6,439,429 | B1 | 8/2002 | Gross | |
| 6,981,614 | B2 | 1/2006 | Niggemyer | |
| 7,051,888 | B2 * | 5/2006 | Antier et al. | 215/235 |
| 7,661,560 | B2 | 2/2010 | Murray | |
| 7,762,414 | B2 | 7/2010 | Uytterhaeghe et al. | |
| 7,882,977 | B2 | 2/2011 | Johnson | |
| 8,231,025 | B2 | 7/2012 | Johnson | |
| 8,573,445 | B2 * | 11/2013 | Murray | 222/107 |
| 2008/0073348 | A1 * | 3/2008 | Pritikin et al. | 220/278 |

(Continued)

*Primary Examiner* — Kevin P Shaver
*Assistant Examiner* — Robert Nichols, II
(74) *Attorney, Agent, or Firm* — WestRock Intellectual Property Group

(57) ABSTRACT

A one-piece dispensing closure for a pouch-like container includes an integrally formed closure body, dispensing neck, hinged cap, a tamper-evident closure system and a latch for maintaining the cap in an open position. The closure body includes a "canoe"-shaped skirt portion which is heat sealed to a film-like pouch and a neck portion having a dispensing orifice for dispensing a product from the pouch. A cap is connected to the closure body by a living hinge to allow the user to selectively open and close the container. The dispensing closure further includes a tamper-evident tear strip that is integrally formed with the cap body, and detachable from the cap body. A ledge formed on the inner surface of the tear strip engages an interfitting locking tab formed on the outer surface of the closure body to prevent opening of the cap without removing the tear strip.

15 Claims, 5 Drawing Sheets

(56) References Cited

U.S. PATENT DOCUMENTS

2009/0277861 A1 11/2009 Long, Jr.
2009/0285510 A1 11/2009 Huang
2010/0126995 A1 5/2010 Komet et al.
2014/0252033 A1* 9/2014 Murray ..... 222/107

* cited by examiner

DISPENSING CLOSURE

CROSS-REFERENCE TO RELATED APPLICATIONS

The present application is a non-provisional of and claims the benefit of U.S. Application No. 61791058, filed Mar. 15, 2013, the entire contents of which are incorporated herein by reference.

BACKGROUND OF THE INVENTION (1) Field of the Invention

The instant invention relates to dispensing closures for containers and more specifically to a one-piece dispensing closure for a pouch-like container.

(2) Description of Related Art

Dispensing containers are used in a variety of industries for dispensing of various liquid products. For example, dispensing containers may be used for shampoo, lotion, condiments, or beverages. As integrated dispensing closures become more prevalent in all industries, consumers push for their use on an ever expanding array of products and packages, and product manufacturers push for unique solutions and reduced costs to promote sales and maintain profit margins.

SUMMARY OF THE INVENTION

A one-piece dispensing closure for a pouch-like container includes an integrally formed closure body, dispensing neck, hinged cap, tamper-evident closure system and latch for maintaining the cap in an open position. The present dispensing closure is particularly configured and arranged for molding as a one-piece entity to reduce manufacturing costs.

The closure body includes a closure deck and a "canoe"-shaped skirt portion extending downwardly from the closure deck, the skirt portion being receivable within an open mouth of the pouch-like container. The skirt portion has heat sealing formations on an outer surface thereof which are configured and arranged for heat sealing to an inner surface of the mouth of pouch container.

The closure body further includes a neck portion extending upwardly from the closure deck. The skirt portion includes an entrance orifice and the neck portion includes a dispensing orifice and the closure body further includes an interior wall extending through the closure body from the entrance orifice to the dispensing orifice to define a flow path through the closure body.

The dispensing closure further includes a cap having an upper wall and an outer sidewall depending downwardly from the upper wall. An integrally formed living hinge connects the cap to the closure body and provides for hinged movement of the cap between a closed position and an open position. The cap further includes an annular sealing wall depending downwardly from the upper wall and engages with the dispensing orifice to seal the dispensing orifice when the cap is in the closed position. An arcuate tamper-evident tear strip is integrally formed with the cap where the tear strip is connected to the cap by at least two frangible elements extending between an inner surface of the tear strip and the outer sidewall of the cap. The tear strip is selectively detachable from the cap by a user by breaking the frangible elements. The tear strip includes a recessed ledge formed on the inner surface thereof and a locking tab is formed on an outer surface of the neck portion of the closure body. The locking tab is positioned to engage the ledge on the tear strip when the cap is in the closed position whereby the locking tab and the ledge cooperate to prevent the cap from being moved from the closed position to the open position without detaching the tear strip from the cap.

To selectively maintain the cap in an open position for dispensing, a latch recess is defined within the outer sidewall of the cap above the living hinge and a latch protrusion is provided on the outer surface of the neck portion of the closure body below the living hinge. The latch recess frictionally engages with the latch protrusion to selectively maintain the cap in the open position.

DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DESCRIPTION OF THE PREFERRED EMBODIMENT

Figure 1:
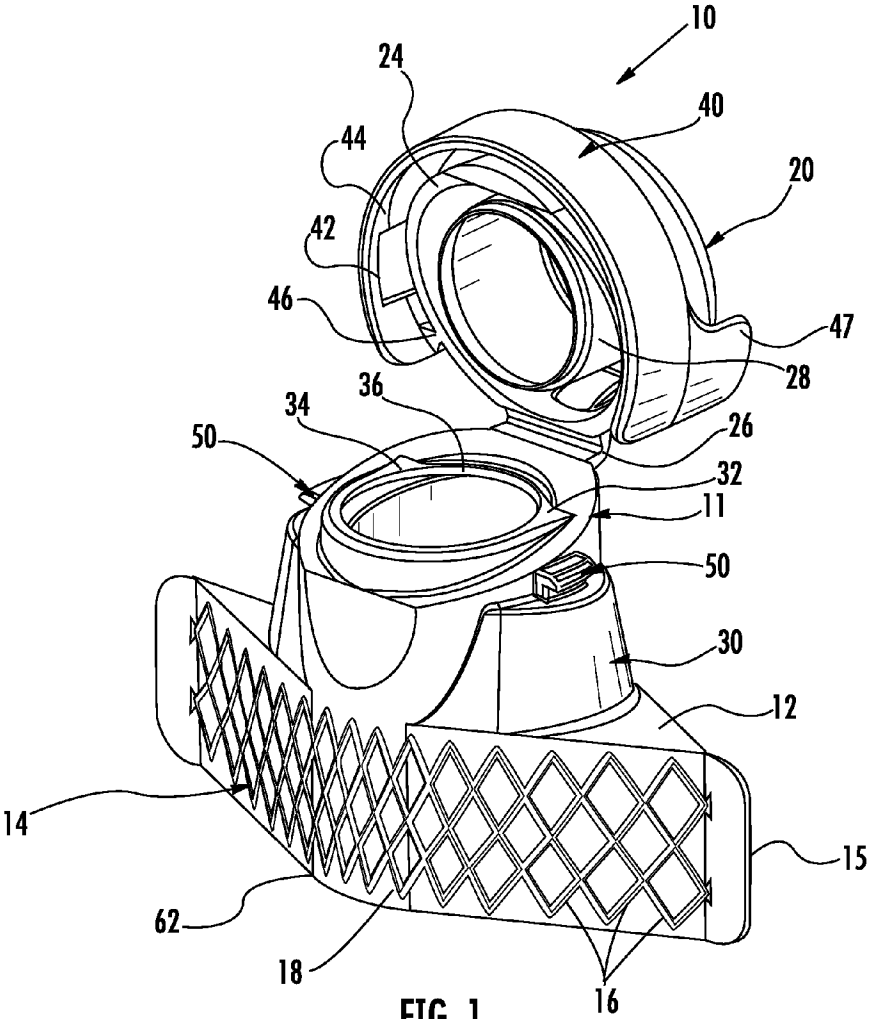
FIG. 1 is a perspective view of an exemplary embodiment of the pouch fitment of the present invention.

Referring now to the drawings, an exemplary embodiment of the pouch fitment of the instant invention is illustrated and generally indicated at 10 in FIGS. 1-5. As will hereinafter be more fully described, the instant pouch fitment provides a one-piece dispensing closure for a pouch-like container including an integrally formed closure body, a dispensing neck, a hinged cap, a tamper-evident closure system and a latch for maintaining the cap in an open position. The present dispensing closure is particularly configured and arranged for molding as a one-piece entity to reduce manufacturing costs.

The pouch fitment 10 of the present invention is manufactured separately from a pouch-like container and then mounted within an end of the container to provide a tamper-evident closure for the pouch-like container. The pouch fitment 10 of FIG. 1 has a closure body 11 that includes a closure deck 12 and a "canoe"-shaped skirt portion 14 extending downwardly from the closure deck 12. The pouch fitment engages the pouch-like container by way of the skirt portion 14, which is receivable within an open mouth of the pouch-like container. Heat sealing formations 16 provided on an outer surface 18 of the skirt portion 14 are configured and arranged for heat sealing the skirt portion 14 to an inner surface of the mouth of the pouch container. Thus, once the pouch fitment is placed within an open end of a pouch-like container and an outer surface 18 of the skirt portion 14 is in facing engagement with an inner surface of the pouch-like container, the heat sealing formations are heated, forming a seal between the container and the pouch fitment. This seal between the skirt portion and the container is sufficiently strong that the seal does not deteriorate during shipment and normal use of the product.

FIGS. 1-5 show one embodiment of the canoe-shaped skirt portion. The skirt portion of this embodiment has an outer surface that includes a front outer surface 17 and a rear outer surface 19 that join together at vertical edges 15 that are sealed. The front and rear views of FIGS. 2*a* and 2*b* along with the right and left views of FIGS. 3*a* and 3*b* show the front and rear outer surfaces of the skirt portion 14 as being generally symmetrical.

Although FIGS. 1-5 show a canoe-shaped skirt portion 14, other shapes could be used to engage containers having different outer shapes. For example, a circular skirt portion 14 could be used to engage a container end that is in the shape of a circular tube. Other shapes could be used without departing from the scope of the present invention.

The skirt portion 14 of the pouch fitment of the present invention is integrally formed with the cap 20, neck portion 30, and tear strip 40, among other features. The pouch fitment may be formed by injection molding, though other manufacturing methods may be used without departing from the scope of the present invention. FIGS. 1-3*b* show the pouch fitment as it may appear after being manufactured but before it has been secured in the mouth of a pouch or first closed by the manufacturer.

When the pouch fitment is secured to a pouch that is filled with a product such as shampoo, food, or other liquid, the manufacturer may close the cap so the product may be shipped to the consumer. The cap 20 is formed with an upper wall 22 and an outer sidewall 24 depending downwardly from the upper wall 22. After purchase, the end user may move the cap 20 to an open position, such as in FIG. 3*a*, from a closed position, such as in FIG. 4*a*, and back by way of an integrally formed living hinge 26 that connects the cap 20 to the closure body 11.

Figure 4B:
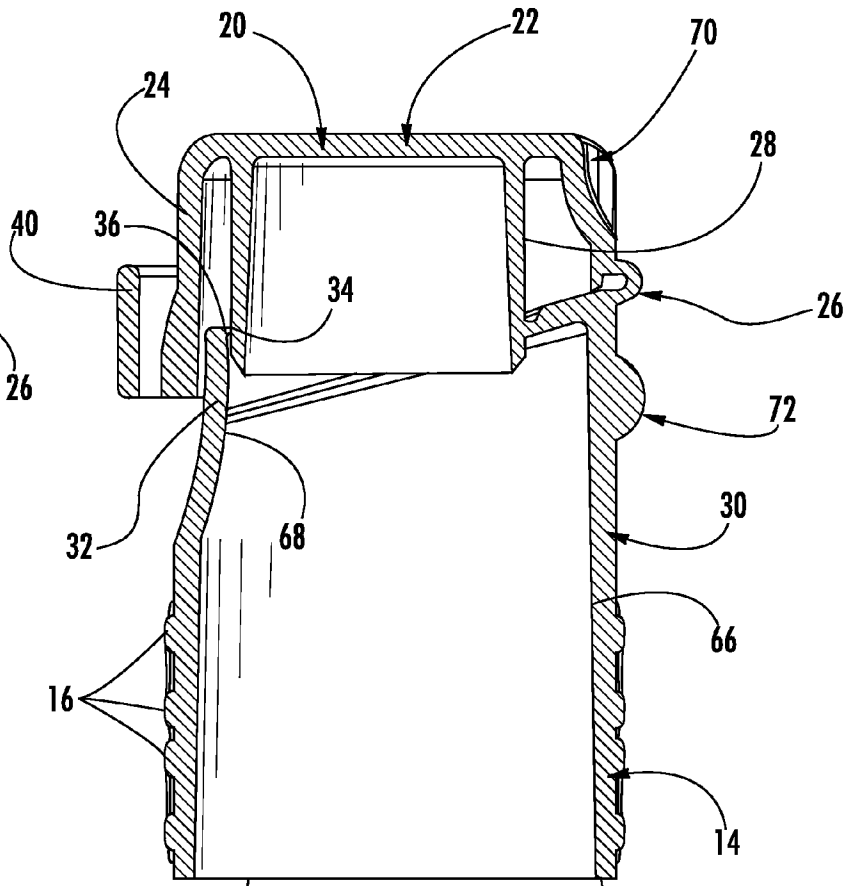
FIG. 4*b* is a cross sectional thereof.
Figure 4A:
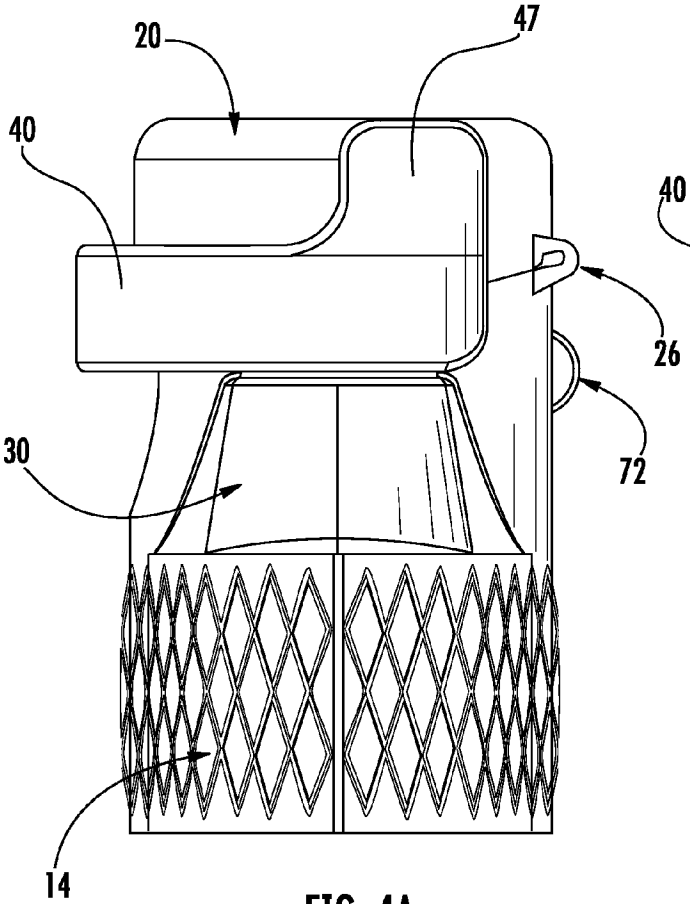
FIG. 4*a* is a side view thereof in a closed position.
Figure 5:
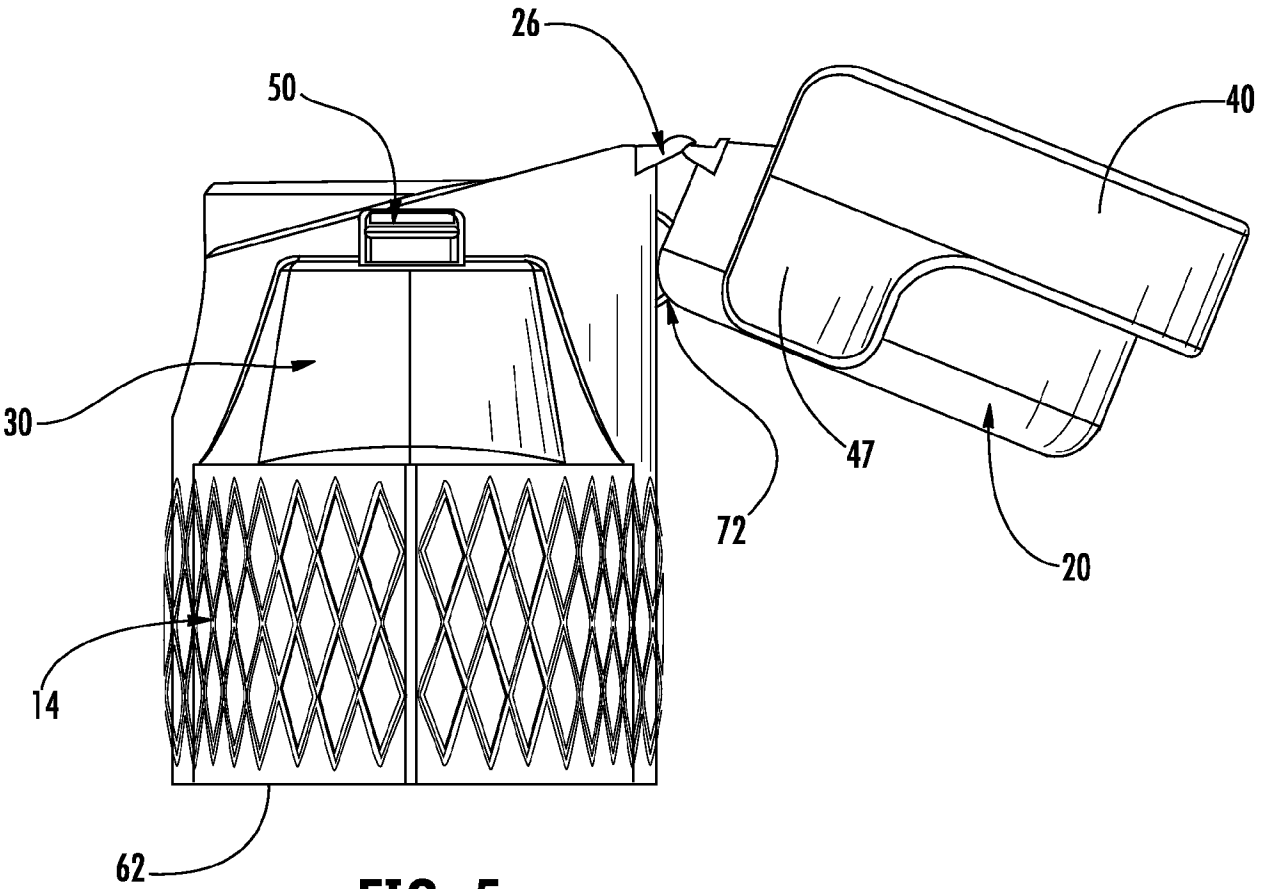
FIG. 5 is a side view thereof in an open position.

In the closed position of FIGS. 4*a* and 4*b*, the upper end 32 of the neck portion 30 partially extends within the area enclosed by the outer sidewall 24 of the cap 20. An annular sealing wall 28 depending downwardly from the upper wall 22 of the cap 20 engages with the dispensing orifice 34 to seal the dispensing orifice 34. A sealing bead 36 extends inwardly from the dispensing orifice 34 to flexibly engage the sealing wall 28, thus forming a seal around the circumference of the sealing wall 28 so that contents of the pouch cannot pass through dispensing orifice 34 of the pouch fitment, which is described in more detail below.

When the container is first provided to a consumer, it is important for the consumer to be able to identify whether the container has been previously opened. For this purpose, the present invention provides an arcuate tamper-evident tear strip 40 that is integrally formed with the cap 20.

Before the tamper-evident tear strip 40 is removed by the user, the tear strip 40 prevents the cap from being moved from the closed position to an open position. As shown in FIG. 1, the tear strip 40 includes recessed ledges 42 formed on the inner surface 44 thereof. The neck portion 30 of the closure body 11 extends upwardly from the closure deck 12 and there are two locking tabs 50 formed on opposing sides of an outer surface 52 of the neck portion. When the manufacturer first moves the cap from an open to a closed position, the locking tabs 50 engage the ledges 42 on the tear strip 40 and prevent the cap 20 from being moved from the closed position to the open position without detaching the tear strip 40 from the cap 20.

Some embodiments of the present invention may include a single locking tab 50 that engages a single recessed ledge 42, or multiple latches 50 that each engages one of multiple recessed ledges 42, without departing from the scope of the present invention.

Figure 2B:
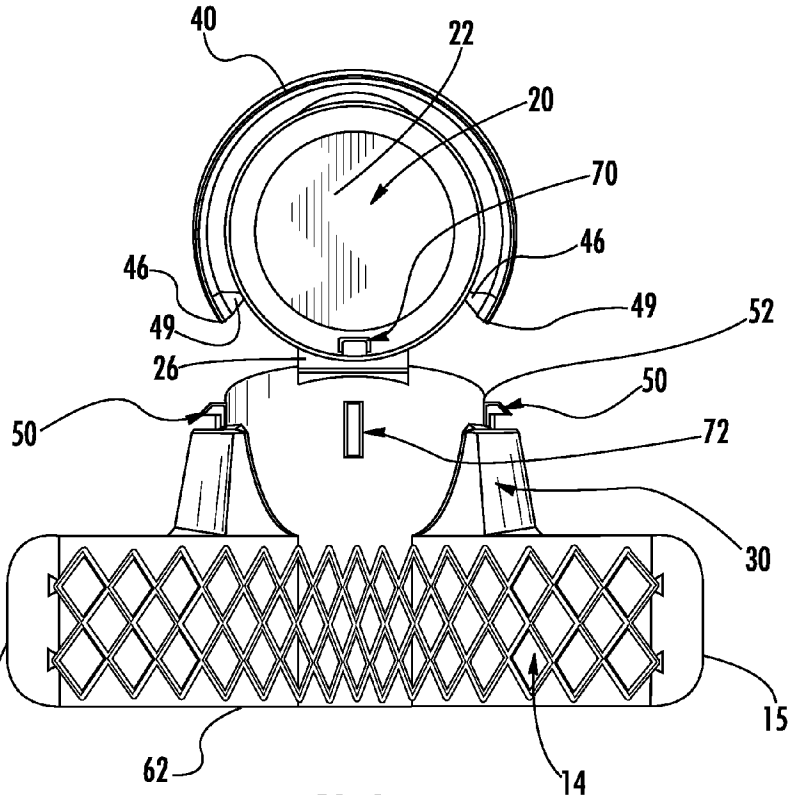
FIG. 2*b* is a rear view thereof.
Figure 2A:
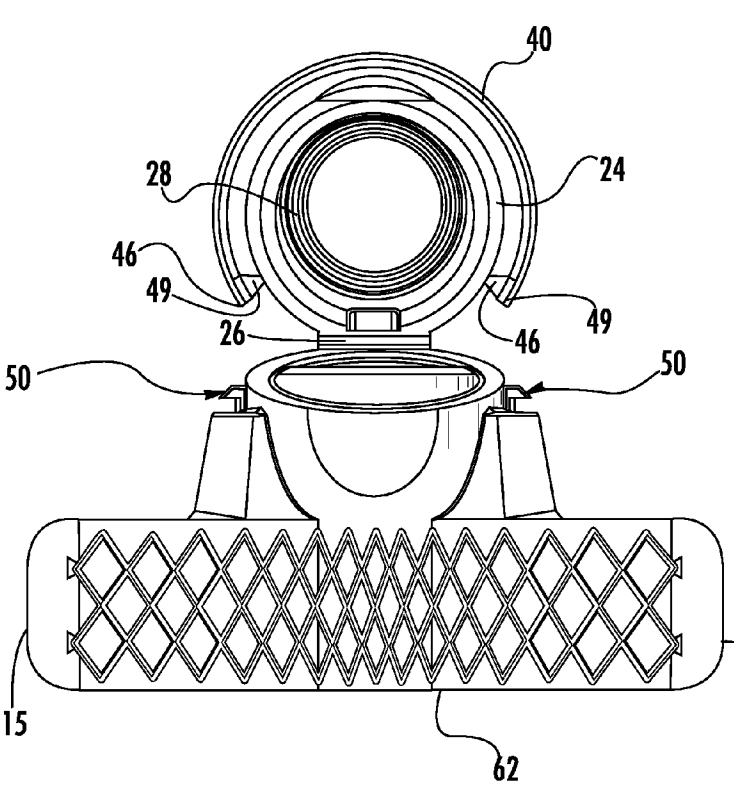
FIG. 2*a* is a front view thereof.
Figures 3A, 3B:
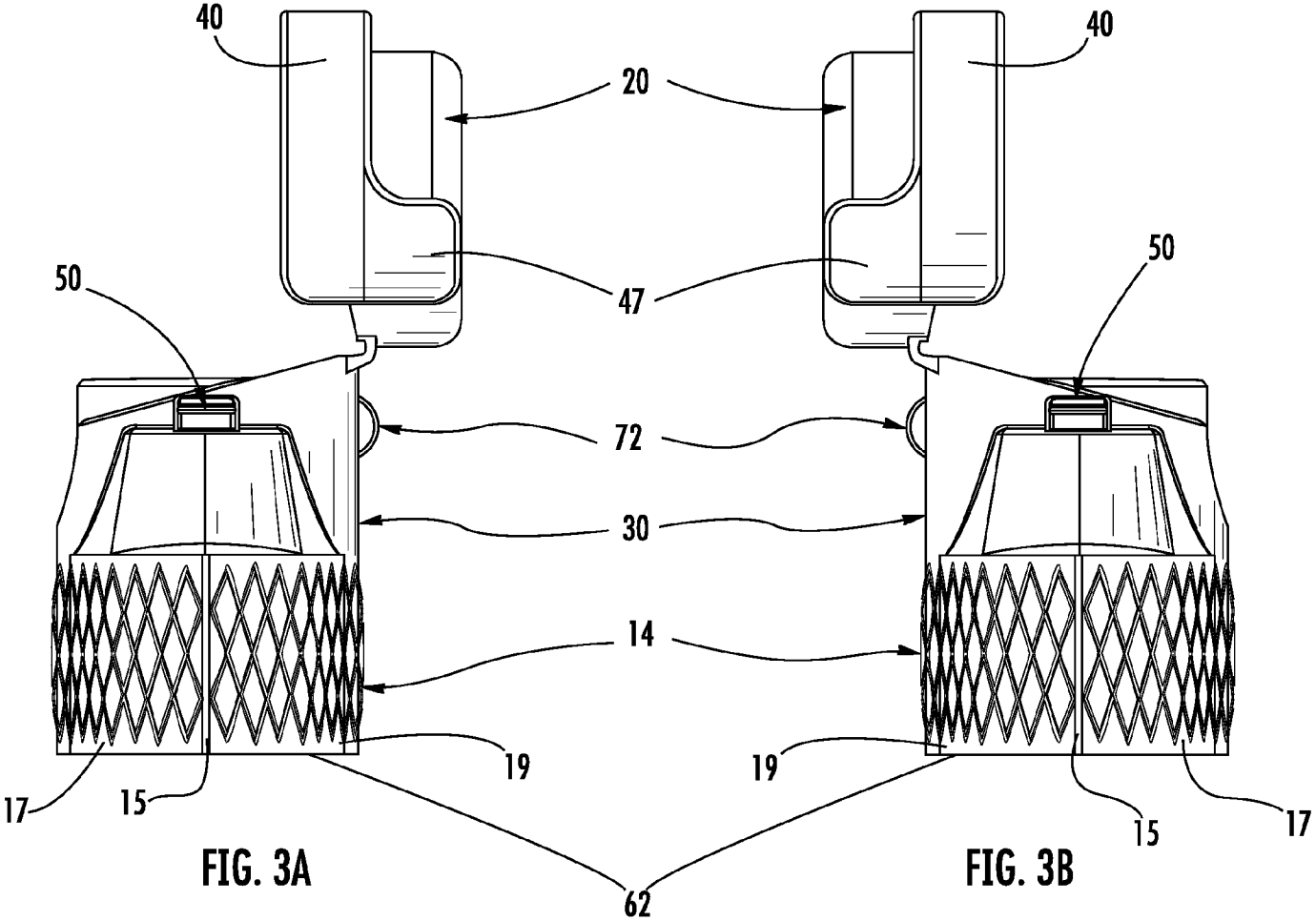
FIG. 3*a* is a right view thereof.
FIG. 3*b* is a left view thereof.

Before dispensing the contents of the container, the consumer must at least partially detach the tamper-evident tear strip 40 from the cap 20 so that the locking tabs 50 of the neck portion 30 no longer engage the recessed ledges 42 of the tear strip 40. The top and bottom views of the tear strip 40 in FIGS. 2*a* and 2*b* show that the tear strip 40 is connected to the cap 20 by at least two frangible elements 46 extending between an inner surface 44 of the tear strip and the outer sidewall 24 of the cap. These frangible elements 46 have a generally triangular profile when viewed from the top. The tapered end of each frangible element 46 is designed to break when a consumer pulls the tear strip 40 with sufficient force. Pull tabs 47 are provided at opposing ends 49 of the tear strip 40 to enable the consumer to easily grip an end 49 of the tear strip 40 and pull it away from the cap 20. Thus, before opening the container, the consumer may inspect the tear strip 40 to see that the frangible elements 46 remain connected to both the tear strip 40 and the cap 20, and then the consumer may remove the tear strip 40 from the cap 20 by breaking the frangible elements 46.

Other embodiments may use more or fewer frangible elements 46 without departing from the scope of the present invention. For example, one end of the tear strip could be fixed to the cap 20, while the other end is connected to the cap 20 by a frangible element 46. Alternatively, several frangible elements 46 could be spaced apart along the length of the tear strip 40, connecting the tear strip 40 to the cap 20 at several points.

Additionally, the frangible elements 46 may be formed in shapes other than triangles. The frangible elements may be rectangular, for example, as long as they include at least one portion that secures the tear strip to the cap 20 but is sufficiently thin to facilitate removal of the tear strip by a consumer.

After the consumer removes the tear strip 40 and moves the cap 20 to an open position, the contents of the pouch may be dispensed. With the skirt portion 14 sealed to the dispensing end of the container, any products dispensed from that end of the container must pass through a flow path defined within the pouch fitment. FIG. 4*b* shows a cross section of the flow path of one embodiment of the present invention, although the cap is in a closed position, preventing a user from dispensing a product. Contents being dispensed first pass through an entrance orifice 60 defined by the lower edge 62 of the skirt portion and finally through a dispensing orifice 34 defined on the neck portion 30 that extends upwardly from the closure deck 12. The entrance orifice 60 and dispensing orifice 34 are connected by an interior wall 66 extending through the closure body. The interior wall may be slightly tapered. Additionally, a convex surface 68 between the entrance orifice 60 and dispensing orifice 34 further aids in guiding the contents of the container as they are dispensed. Thus, when the cap 20 is open, the consumer may squeeze the pouch-like container to push the contents from the container into the entrance orifice 60 of the skirt portion 14, past the interior wall 66, and finally through the dispensing orifice 34 of the neck portion 30.

The dispensing orifice 34 is shown in FIG. 1 as being generally circular. However, in other embodiments, different shapes may be used to suit manufacturer or user preferences. For example, an elongated oval or rectangular dispensing orifice 34 could be used where it is beneficial to dispense a thin, flat layer of a product. Other dispensing orifice designs can be used without departing from the scope of the present invention.

To selectively maintain the cap in an open position for dispensing, and to keep it out of the way of the product being dispensed, a latch recess 70 is defined within the outer sidewall of the cap above the living hinge and a latch protrusion 72 is provided on the outer surface of the neck portion 30 of the closure body below the living hinge 26. The latch recess 70 frictionally engages with the latch protrusion 72 to selectively maintain the cap 20 in the open position. In FIGS. 4*a* and 4*b*, the latch protrusion 72 is shown as having a convex arcuate profile. FIG. 4*b* shows the latch recess 70 as having a concave arcuate profile that generally corresponds to the arcuate profile of the convex latch protrusion 72 such that the protrusion may be more fully received in the latch recess 70. This improves the frictional engagement of the latch protrusion and latch recess.

It can therefore be seen that the instant invention provides a one-piece dispensing closure having a tamper-evident tear strip that prevents a user from opening a cap without at least partially detaching the tear strip from the cap.

The present invention also provides a tear strip having a ledge that engages a locking tab on a cap body until the tear strip is at least partially detached from the cap.

The instant invention further provides a latch back mechanism that allows the user to secure the cap to the closure body when the cap is in an open state, so that the cap is out of the way of the dispensing orifice on the closure body.

For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A one-piece dispensing closure for use in connection with a pouch-like container, said dispensing closure comprising:

a closure body having a closure deck and a canoe-shaped skirt portion extending downwardly from said closure deck, said skirt portion being receivable within an open mouth of said pouch-like container and having heat sealing formations on an outer surface thereof which are configured and arranged for heat sealing to an inner surface of said mouth of said container, said closure body further including a neck portion extending upwardly from said closure deck, said skirt portion including an entrance orifice and said neck portion including a dispensing orifice;

said closure body further including an interior wall extending through said closure body from said entrance orifice to said dispensing orifice to define a flow path through said closure body;

a cap having an upper wall and an outer sidewall depending downwardly from said upper wall;

an integrally formed living hinge connecting said cap to said closure body and providing for hinged movement of said cap between a closed position and an open position, said cap further including an annular sealing wall depending downwardly from said upper wall and engaging with said dispensing orifice to seal said dispensing orifice when said cap is in said closed position;

an arcuate tamper-evident tear strip integrally formed with said cap, said tear strip being connected to said cap by at least two frangible elements extending between an inner surface of the tear strip and the outer sidewall of the cap, said tear strip being selectively detachable from said cap by a user by breaking said frangible elements;

said tear strip including a recessed ledge formed on said inner surface thereof;

a locking tab formed on an outer surface of said neck portion of said closure body, said locking tab being positioned to engage said ledge on said tear strip when said cap is in said closed position, said locking tab and said ledge cooperating to prevent said cap from being moved from said closed position to said open position without detaching said tear strip from said cap;

a latch recess defined within said outer sidewall of said cap above said living hinge; and a latch protrusion on said outer surface of said neck portion of said closure body below said living hinge, said latch recess engaging with said latch protrusion to selectively maintain said cap in said open position.

2. The dispensing closure of claim 1 wherein said tear strip includes pull tabs at opposing ends thereof to facilitate removal of the tear strip.

3. The dispensing closure of claim 1 wherein said frangible elements are located at opposing ends of the tear strip.

4. The dispensing closure of claim 2 wherein said frangible elements are located at opposing ends of the tear strip adjacent said pull tabs.

5. The dispensing closure of claim 1 further comprising a sealing bead on an inner peripheral lip of said dispensing orifice, said sealing bead engaging an outer surface of said annular sealing wall when said cap is in said closed position.

6. The dispensing closure of claim 1 further comprising two spaced recessed ledges on said tear strip and two spaced locking tabs on said neck portion of said closure body, said locking tabs being positioned to engage said recessed ledges.

7. The dispensing closure of claim 3 further comprising two spaced recessed ledges on said tear strip and two spaced locking tabs on said neck portion of said closure body, said locking tabs being positioned to engage said recessed ledges.

8. The dispensing closure of claim 4 further comprising two spaced recessed ledges on said tear strip and two spaced locking tabs on said neck portion of said closure body, said locking tabs being positioned to engage said recessed ledges.

9. A dispensing closure for use in connection with a pouch-like container, said dispensing closure comprising:

a closure body having a closure deck and a canoe-shaped skirt portion extending downwardly from said closure deck, said skirt portion having heat sealing formations on an outer surface thereof, said closure body further including a neck portion extending upwardly from said closure deck, said skirt portion including an entrance orifice and said neck portion including a dispensing orifice;

said closure body further including an interior wall extending through said closure body from said entrance orifice to said dispensing orifice to define a flow path through said closure body;

a cap having an upper wall and an outer sidewall depending downwardly from said upper wall;

a living hinge connecting said cap to said closure body, said cap further including an annular sealing wall depending downwardly from said upper wall and engaging with said dispensing orifice to seal said dispensing orifice when said cap is in a closed position;

an arcuate tamper-evident tear strip integrally formed with said cap, said tear strip being connected to said cap by a frangible element extending between an inner surface of the tear strip and the outer sidewall of the cap, said tear strip being selectively detachable from said cap by a user by breaking said frangible element;

said tear strip including a recessed ledge formed on said inner surface thereof;

a locking tab formed on an outer surface of said neck portion of said closure body, said locking tab being positioned to engage said ledge on said tear strip when said cap is in said closed position, said locking tab and said ledge cooperating to prevent said cap from being moved from said closed position to an open position without detaching said tear strip from said cap;

a latch recess defined within said outer sidewall of said cap above said living hinge; and a latch protrusion on said outer surface of said neck portion of said closure body below said living hinge, said latch recess engaging with said latch protrusion to selectively maintain said cap in said open position.

10. The dispensing closure of claim 9 wherein said tear strip includes pull tabs at opposing ends thereof to facilitate removal of the tear strip.

11. The dispensing closure of claim 9 wherein said closure includes at least two frangible element and said frangible elements are located at opposing ends of the tear strip.

12. The dispensing closure of claim 9 further comprising a sealing bead on an inner peripheral lip of said dispensing orifice, said sealing bead engaging an outer surface of said annular sealing wall when said cap is in said closed position.

13. The dispensing closure of claim 9 further comprising two spaced recessed ledges on said tear strip and two spaced locking tabs on said neck portion of said closure body, said locking tabs being positioned to engage said recessed ledges.

14. The dispensing closure of claim 11 further comprising two spaced recessed ledges on said tear strip and two spaced locking tabs on said neck portion of said closure body, said locking tabs being positioned to engage said recessed ledges.

15. The dispensing closure of claim 12 further comprising two spaced recessed ledges on said tear strip and two spaced locking tabs on said neck portion of said closure body, said locking tabs being positioned to engage said recessed ledges.

* * * * *